United States Patent [19]

Panevska

[11] 4,184,406

[45] Jan. 22, 1980

[54] MINIATURE MANUALLY OPERABLE MUSICAL INSTRUMENT

[76] Inventor: Mary A. Panevska, Rte. 2- Pleasant Dr., Princeton, Wis. 54968

[21] Appl. No.: 892,215

[22] Filed: Apr. 4, 1978

[51] Int. Cl.[2] ..... G10D 13/08

[52] U.S. Cl. ..... 84/408; 84/94 R

[58] Field of Search ..... 84/94, 95, 102, 103, 84/402, 404, 408, 98

[56] References Cited

U.S. PATENT DOCUMENTS

| | | | |
|---|---|---|---|
| 123,969 | 2/1872 | Young | 84/408 |
| 579,031 | 3/1897 | Zintzsch | 84/404 |
| 2,880,639 | 4/1959 | Gorr | 84/95 |
| 3,077,856 | 2/1963 | Rieth | 84/404 X |
| 3,809,793 | 5/1974 | Joslyn | 84/404 |

*Primary Examiner*—Lawrence R. Franklin

[57] ABSTRACT

A small musical comb is secured in a resonant housing and provides a plurality of musical bars of selective tone when vibrated. A separate manually operable rotary actuator carries one or more protrusions to successively engage the end of one bar and flex and then release it to vibrate the same.

7 Claims, 7 Drawing Figures

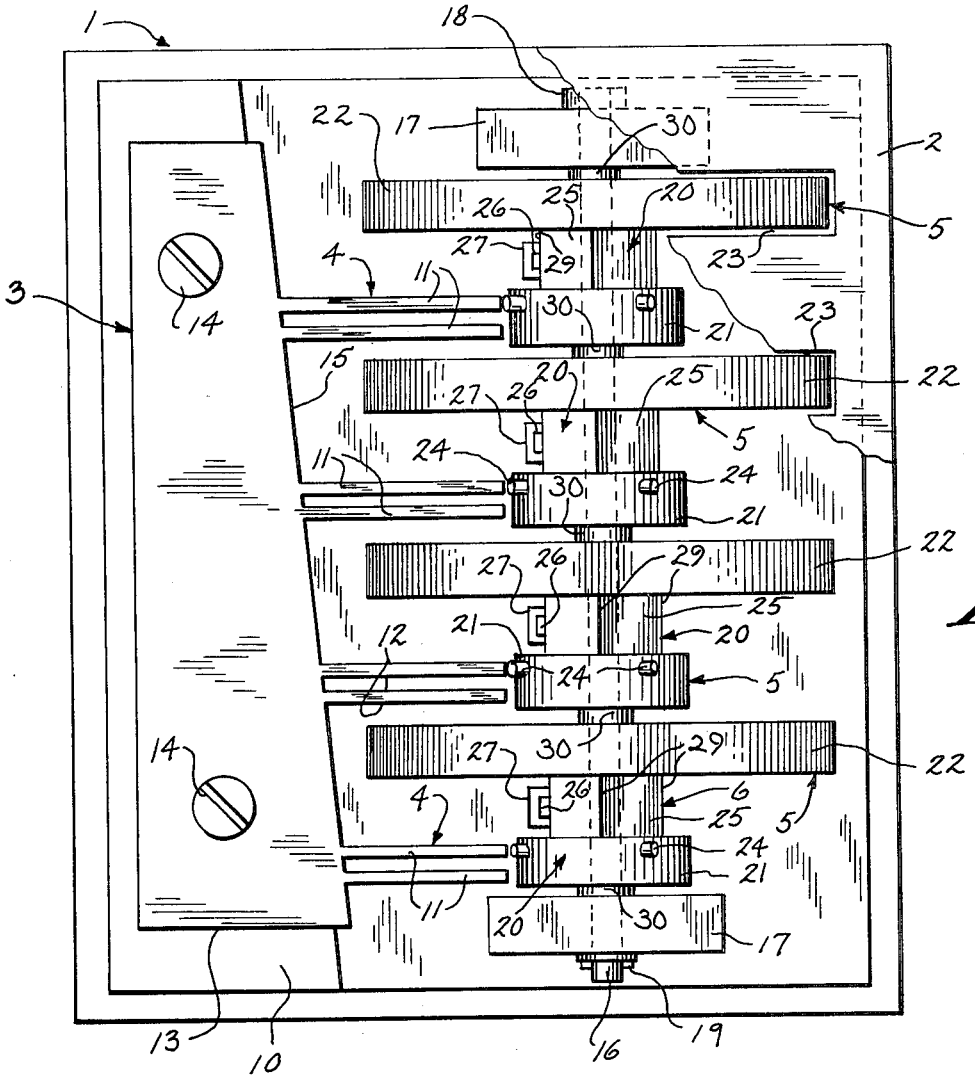
Fig. 1
Fig. 2
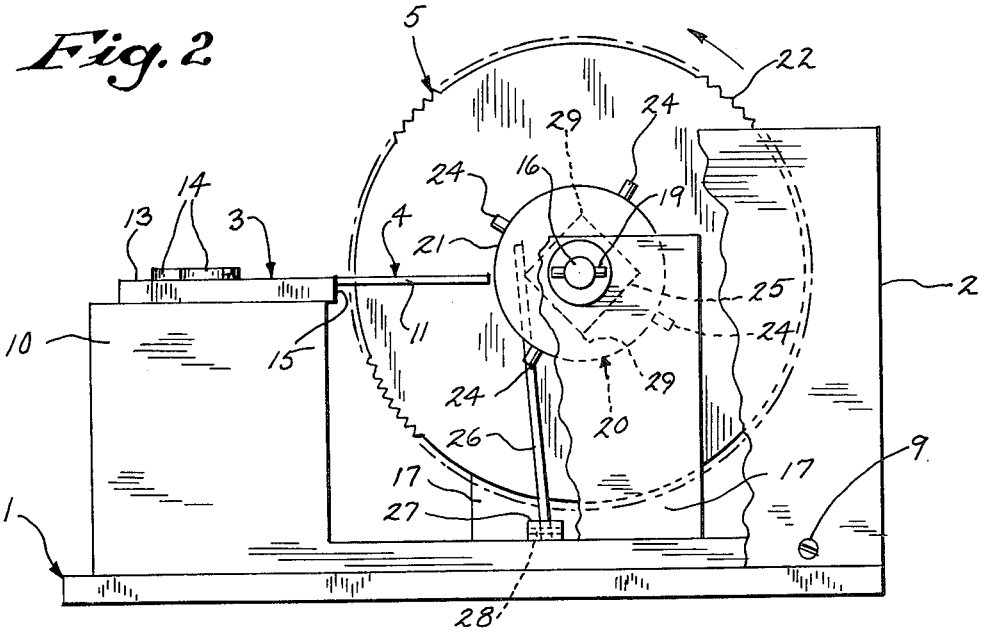

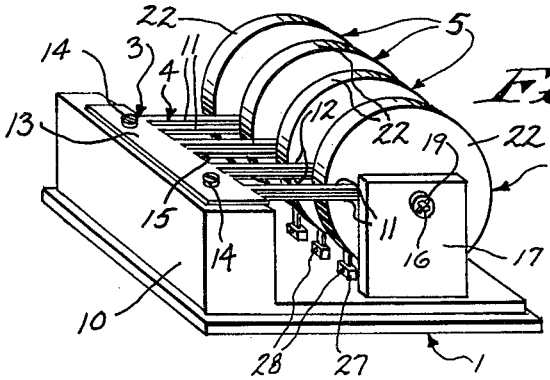
Fig. 3
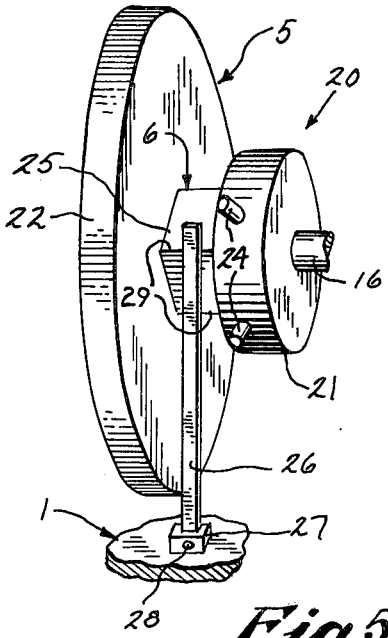
Fig. 5
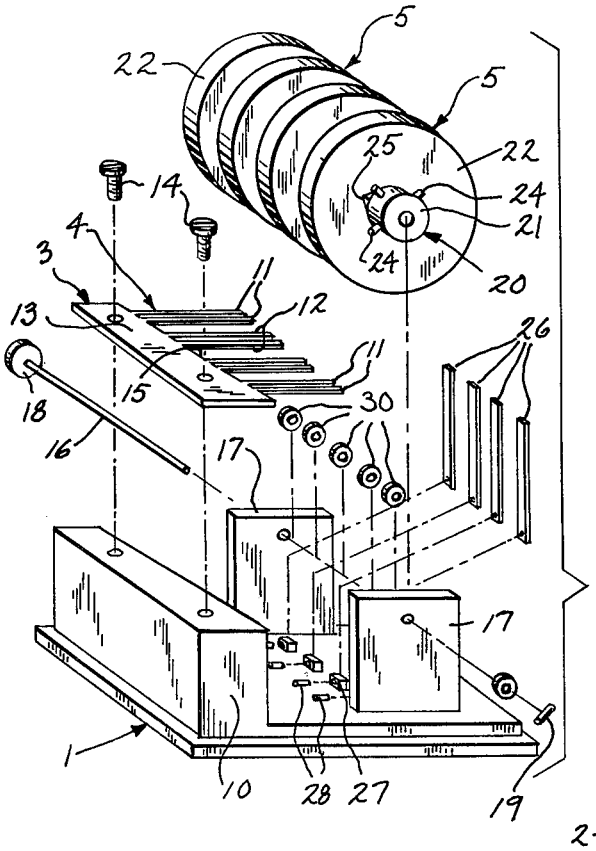
Fig. 4
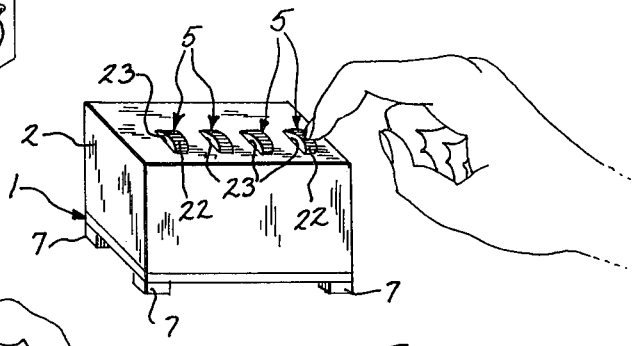
Fig. 6
Fig. 7
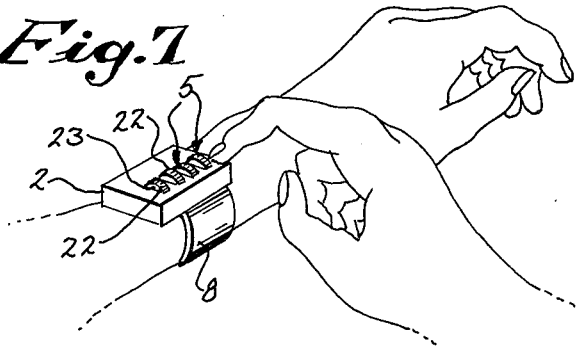

MINIATURE MANUALLY OPERABLE MUSICAL INSTRUMENT

BACKGROUND OF THE INVENTION

This invention relates to a miniature manually operable musical instrument.

One of the objectives of the invention is to provide a small soft toned instrument that an operator can play at random to create his own music and thereby benefit by relieving stresses and tensions of modern living.

Most musical instruments are unsuitable for this purpose because of their size, general lack of ready portability and cost, and the skill generally required to play them. Small instruments, such as harmonicas, are inconvenient to operate and are generally sufficiently loud to disturb other nearby persons.

Most miniature playing instruments are adapted only for playing fixed pre-written musical pieces and do not give the satisfaction of creative soft tone development so necessary for relief of stress, nervous tension and boredom.

For instance, the Electrified Miniature Music Box disclosed in U.S. Pat. No. 2,489,149 employs a fixed music roll having projections which engage the corresponding fingers of a musical comb. Similarly, U.S. Pat. No. 2,882,778 discloses a toy piano operating on the same principle. These do not permit the operator to create his own music.

Whistling and humming are, today, about the only easily available musical means people have to relieve their pent-up feelings, and many people are not able to take advantage of these means.

SUMMARY OF THE INVENTION

The present invention is directed to a miniature musical instrument which can be in a form of jewelry, such as a pendant, pin or wrist band, or can be carried in a lady's purse or in a pocket of clothing, or can be conveniently placed in a bathroom or automobile for operation when needed. Features of the invention, however, may be employed in larger embodiments of musical instruments.

The instrument of the present invention employs a plurality of musical sound producing units in a resonating housing and which are actuated by separate manual means to strike them in any order with any time intervals and either singly or simultaneously.

The musical sound producing units of the preferred embodiment may employ the tuning fork principle and comprise a plurality of pairs of tuning bars with separate actuators for one bar of each pair. The pairs of bars may extend from a common base plate as a musical comb.

Each actuator comprises a rotary member with one or more radially extending striker means such as pins or other protrusions adapted to strike the end of the corresponding bar, flex the bar, and then quickly release it whereby the bar is vibrated to give off a tone. When the bars are arranged in pairs as above explained the bar of the pair adjacent the bar which is primarily vibrated by the striker means will additionally be sympathetically excited, as with a tuning fork, to give off a modified tone that is generally quite pleasing to the ear.

The rotary actuator is biased by suitable means to a position freeing the bar from the striking pin so that the vibration of the bars of the pair may continue freely until diminished to zero or reactuated.

For this purpose where, for instance there are four striking pins spaced equally about the circumference of the rotary actuator, a leaf spring rides upon a generally rectangular shaped portion of the rotary actuator to retain the latter stationary at positions intermediate the driving positions.

This construction enables the spring to assist in accelerating the rotation at the moment of striking of the bar, after which it effectively stops the rotation.

The actuator member and its biasing means may be employed in instruments having musical combs with individual bars not employing the paired arrangement for the bars.

The resonant housing has a series of openings to receive corresponding individual portions of the rotary actuators extending and/or exposed therethrough and providing access for the fingers of the operator to manually turn the actuator and effect striking of the corresponding bar.

BRIEF DESCRIPTION OF THE DRAWINGS

The drawings furnished herewith illustrate a preferred construction of the present invention in which the above advantages and features are clearly disclosed as well as others which will be readily understood from the following description.

FIG. 1 is a top plan view with a portion of the top broken away and other parts sectioned to show details of the mechanism;

FIG. 2 is an end elevation with a portion of the end broken away and other parts sectioned;

FIG. 3 is a perspective view of the mechanism with the top and sides of the housing removed;

FIG. 4 is an exploded view of the parts shown in FIG. 3;

FIG. 5 is a perspective view of an actuator with the biasing means therefor;

FIG. 6 is a perspective showing of a table top model for the instrument; and

FIG. 7 is a perspective showing of a model for wearing on the wrist of the operator.

DESCRIPTION OF THE PREFERRED EMBODIMENTS

The musical instrument illustrated in the drawings comprises in general a base 1 with a resonant housing 2 mounted thereon, a musical comb 3 mounted on the base with a plurality of musical vibratory units 4 extending inwardly from one side of the housing, individual manually operated rotary actuators 5 disposed to strike the ends of given vibratory units to vibrate the same, and biasing means 6 to assist the actuators in striking the units and also retain the actuators out of engagement with their respective units.

The base 1 carries the rest of the instrument and may have cushion support member 7 at the corners as shown in FIG. 6 for supporting the instrument upon a table top, or may be attached to a wrist band 8 as shown in FIG. 7. Various means for supporting or carrying base 1 may be employed.

The housing 2 is removably fastened to base 1 as by small screws 9. See FIG. 2. The housing 2 may be of any convenient shape and may be decorated as desired, that shown being a rectangular box shaped to fit upon a rectangular base 1. Preferably the housing is constructed to provide a resonant sounding board effect.

The musical comb 3 is mounted on platform member 10 adjacent one side of housing 2.

The vibratory units 4 of comb 3 extend freely from the mounting 10 inwardly of housing 2 and may comprise individual generally parallel steel bars 11 or pairs of bars of selective length, width and thickness to provide a given distinctive pitch in the resultant musical sound emitted by their vibration.

Each vibratory unit 4 illustrated comprises a pair 12 of bars 11 of generally the same length, width and/or thickness to increase the volume and richness of the sound.

The vibratory units 4 may be individually attached to the mounting 10, or, as shown, preferably integral with a steel plate 13 which is secured to mounting 10 by suitable screws 14.

The plate 13 is preferably tapered in width so that its front edge 15 which carries the bars 11 is disposed at an angle, thereby providing for different length musical vibratory units 4 while maintaining the ends of units 4 in a common plane longitudinal of housing 2. Any suitable number of vibratory units 4 may be employed.

The individual manually operated rotary actuators 5 are mounted for free rotation upon a shaft 16 extending longitudinally of housing 2 spaced from the ends of units 4 and supported at the ends of the shaft by upstanding brackets 17 through which the shaft extends and is held by a suitable head 18 at one end and pin 19 at the other end.

The actuators 5 are spaced along the shaft 16 to provide one actuator for each musical vibratory unit 4.

Each actuator 5 comprises a hub 20 with a trip portion 21 at each end facing the corresponding musical vibratory unit 4 and a hand wheel portion 22 extending upwardly through a slot 23 in the top of housing 2 for manual manipulation of the actuator as illustrated in FIGS. 6 and 7.

The trip portion 21 of hub 20 has a plurality of radially extending trip pins 24 adapted to engage and flex a bar 11 of the corresponding musical vibratory unit 4, as the hub is rotated by hand wheel portion 22.

Any suitable number of pins 24 may be provided, preferably equally spaced circumferentially of the hub 20. The actuators 5 illustrated employ four such pins spaced 90° from each other.

As a pin 24 passes the end of a bar 11 it first flexes it and then releases it to allow the bar to spring back and vibrate at a given pitch. Where the bars 11 are arranged in pairs the second bar will vibrate in sympathy to the first and thereby create a pleasing tone until the vibrations die down.

The intermediate portion 25 of hub 20, between trip portion 21 and hand wheel 22, is preferably of polygonal contour having the same number of sides as there are pins 24. Thus, in the construction illustrated the portion 25 is rectangular in transverse section with four equal sides formed in any manner.

A steel leaf spring 26 extends upwardly from a fixed bracket support 27 on base 1 to which it may be fixed by a pin 28 or otherwise and is tensioned to press radially against the outer surface of portion 25 of each hub 20, and to ride thereon as the hub is rotated by hand wheel 22.

The spring 26 thus tends to retain the hub 20 normally in a position where the spring engages a flat side of portion 25. As the hub 20 is rotated by hand wheel 22 the spring 26 flexes to ride over the corner 29 of portion 25 and upon passing dead center the spring will urge the hub to proceed to the next successive flat surface contact with the spring thereby assisting in the rapid release of the flexed bar.

The operator in moving a hand wheel 22 to impart vibration to the corresponding bar 11 can feel the resistance in the initial movement and then the assistance in the later movement.

For this purpose each pin 24 should be located circumferentially of hub 20 at about the same radius position of a corner 29 so that the spring 26 will be first past dead center when the pin releases the bar 11 and so that when the spring engages a flat side of hub portion 25 it will retain the same in a position where the bar 11 is free to vibrate out of contact with a pin 24. The relationship may vary depending upon the angular location of spring 26.

In order to retain each actuator 5 longitudinally of shaft 16 and prevent the hand wheel 22 from engaging the adjacent musical vibratory unit 4, a suitable spacer washer 30 may be disposed on shaft 16 between adjacent actuators.

Various modes of carrying out the invention are contemplated as being within the scope of the following claims, particularly pointing out and distinctly claiming the subject matter which is regarded as the invention.

I claim:

1. A manually operable musical instrument having a base and a plurality of musical bars fixed at one end of each to the base and adapted to produce individual generally different musical tones when vibrated, characterized in that said musical bars are vibrated individually and selectively at the option of the user by means of a plurality of manually operable rotary actuators mounted on the base for free separate rotation, each actuator having a first portion destined for contact by the user to manually rotate the same and a second portion generally integral with said first portion to rotate therewith and disposed adjacent to the end of a corresponding bar, said second portion having a plurality of circumferentially spaced protrusions positioned so as to flex and release the end of the corresponding bar upon a partial rotation of the actuator thus causing the bar to vibrate upon release from contact, said second portion being formed so that its said protrusions are not touched by the user during said manual rotation, and a resilient biasing means that serves to retain the actuators out of engagement with the corresponding bars except when manually rotated and that also serves to urge said portrusions to rapidly release the corresponding bars once they are flexed.

2. The instrument of claim 1 in which said resilient biasing means comprises a spring disposed generally tangentially to and pressing radially against a peripheral portion of said actuator which is generally polygonal, whereby engagement by said spring with a flat side of said portion of the actuator tends to retain said actuator against rotation.

3. The instrument of claim 1 and a housing for said instrument having at least one opening therein through which the first named portion of each of said corresponding rotary actuators is exposed for manual rotation.

4. The instrument of claim 1 in which there is only one musical bar per actuator.

5. The instrument of claim 1 in which there is more than one bar of the same tone per actuator.

6. The instrument of claim 5 in which only one bar is struck by its actuator while the other bar or bars are of such character that they vibrate in sympathy with the struck bar.

7. The instrument of claim 5 in which the several same toned bars corresponding to any actuator are struck and vibrated one after the other in rapid succession during one partial rotation of the actuator before said biasing means operates to retain the protrusions out of engagement with the bars.

* * * * *